US010711663B2

(12) United States Patent
Altherr et al.

(10) Patent No.: US 10,711,663 B2
(45) Date of Patent: Jul. 14, 2020

(54) VALVE DRIVE FOR AN INTERNAL COMBUSTION ENGINE

(71) Applicant: Mahle International GmbH, Stuttgart (DE)

(72) Inventors: Patrick Altherr, Stuttgart (DE); Thorsten Ihne, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 16/412,397

(22) Filed: May 14, 2019

(65) Prior Publication Data

US 2019/0353062 A1 Nov. 21, 2019

(30) Foreign Application Priority Data

May 15, 2018 (DE) ..... 10 2018 207 457

(51) Int. Cl.
*F01L 13/00* (2006.01)
*F01L 9/02* (2006.01)
*F01L 1/047* (2006.01)

(52) U.S. Cl.
CPC ..... *F01L 13/0015* (2013.01); *F01L 1/047* (2013.01); *F01L 9/021* (2013.01); *F01L 2001/054* (2013.01); *F01L 2105/02* (2013.01)

(58) Field of Classification Search
CPC . F01L 1/047; F01L 1/053; F01L 1/181; F01L 2001/186; F01L 1/2411; F01L 1/267; F01L 1/46; F01L 13/0005; F01L 2013/001; F01L 13/0036; F01L 13/06; F01L 13/08
USPC ..... 123/90.16, 90.17, 90.2, 90.39, 90.4, 123/90.44, 481, 198 F
See application file for complete search history.

(56) References Cited

U.S. PATENT DOCUMENTS 6,439,195 B1 * 8/2002 Warner ..... F01L 13/06 123/320
2016/0281612 A1 9/2016 Toth et al.
2017/0362970 A1 * 12/2017 Niekamp ..... F01L 1/185
2018/0163578 A1 6/2018 Kim et al.
2018/0230862 A1 8/2018 Altherr

FOREIGN PATENT DOCUMENTS

DE 10 2013 215 946 A1 2/2015
DE 10 2016 204 893 A1 2/2017

* cited by examiner

*Primary Examiner* — Jorge L Leon, Jr.
(74) *Attorney, Agent, or Firm* — Fishman Stewart PLLC

(57) ABSTRACT

A valve drive of an internal combustion engine may include a camshaft, at least one cam follower, and a hydraulic actuating element. The camshaft may include at least one first cam structured as a brake cam and a second cam structured as an exhaust cam. The at least one first cam may have a reduced cam lift relative to the second cam. The at least one cam follower may be connected to an exhaust valve of the internal combustion engine via a rocker. The hydraulic actuating element may include a plunger that is adjustable to an extended position and a retracted position. When the plunger is in the extended position, the hydraulic actuating element may be operatively connected to the brake cam providing a braking stroke. When the plunger is in the retracted position, the hydraulic actuating element may be operatively disconnected from the brake cam providing a cylinder cutout.

20 Claims, 3 Drawing Sheets

VALVE DRIVE FOR AN INTERNAL COMBUSTION ENGINE

CROSS-REFERENCE TO RELATED APPLICATION

This application claims priority to German Application No. DE 10 2018 207 457.7, filed on May 15, 2018, the contents of which are hereby incorporated by reference in its entirety.

TECHNICAL FIELD

The invention relates to a valve drive of an internal combustion engine having a camshaft and having at least one cam follower. The invention additionally relates to an internal combustion engine having such a valve drive.

BACKGROUND

Generic valve drives for an internal combustion engine having a camshaft and having at least one cam follower as well as a first cam that is non-rotatably arranged on the camshaft and with a second cam that is arranged axially adjacent to the first cam are already known. Here, the cam follower is drive-connected in a first position to the first cam of the respective cam group and in a second position to the second cam of the respective cam group.

An adjusting device of the valve drive having a first adjustable engagement peg and having a second adjustable engagement peg interacts in each case with a slotted guide arranged on the camshaft. By way of the adjusting device, the cam follower can be adjusted between the first position and the second position and the valve drive activated. The first slotted guide and the second slotted guide are arranged laterally on the cams on the camshaft. By way of the slotted guide, the engagement pegs which are arranged on the pin spaced next to one another can be adjusted between a basic position and a shifting position. In the basic position, there is no contact with the associated slotted guide while in the shifting position the respective engagement peg interacts with the associated slotted guide.

In order to be able to achieve as high as possible a flexibility during the operation of an internal combustion engine the focus is increasingly on valve drive applications and exhaust brake systems as well as the possibility of a cylinder cutout in order to be able to optimise for example the combustion in a part load operation. In particular parallel applications of exhaust brake operation and cylinder cutout function increasingly raise interest. Systems that are based on the shifting of a roller pin or coupling pin by means of mechanical positive guidance to the camshaft, such as are conceivable for example with cam followers having at least two rocker arms that can be optionally coupled to one another or separated from one another (connectable rocker arms) require a corresponding cam lift for initiating the shifting operation. Because of this, the use of zero lift rounds, via which a cylinder cutout can be brought about for example, is limited. Alternatively, three-stage systems which can switch between a fired, a braking and a cutout mode, is obviously also conceivable but these are complex, critical in terms of installation space and cost-intensive. With so-called axially adjustable cam followers (shifting rollers) a cylinder cutout using a zero lift round is not generally possible.

SUMMARY

The present invention therefore deals with the problem of stating an improved or at least an alternative embodiment for a valve drive of the generic type, which in particular overcomes the disadvantages known from the prior art and for example creates a valve drive which in a simple design and installation space-optimised manner offers both the possibility of a braking stroke and also the possibility of a cylinder cutout.

According to the invention, this problem is solved through the subject of the independent claim(s). Advantageous embodiments are subject of the dependent claim(s).

The present invention is based on the general idea of now employing the utilisation of the braking stroke also for the cylinder cutout for the first time. Here use is made of the fact that cam profiles, which are employed for decompression brakes, generally only have a short stroke. Combined with a shiftable hydraulic actuating element, a clearance between an exhaust valve and its actuation can now be created when required, which exceeds the cam lift, so that in the deactivated state no transmission of the braking stroke onto the associated exhaust valve occurs and by way of this a cylinder cutout can be realised. When the clearance is closed by adjusting the hydraulic actuating element, the valve drive according to the invention again changes into the braking mode. By way of this it is possible for the first time to form a three-stage functionality (normal, braking and cutout function) by means of a merely two-stage system, which during the actual adjustment merely changes between the normal exhaust cam and the brake cam. The valve drive of an internal combustion engine according to the invention comprises a camshaft as well as at least one cam follower. The camshaft comprises at least one first cam that is non-rotatably fixed on the camshaft and a second cam is axially adjacent thereto, wherein the cam follower in a first position is drive-connected to the first cam and in a second position to the second cam. The valve drive comprises at least one adjusting device for adjusting the cam follower between the first and the second cam. The second cam according to the invention is now formed as an exhaust cam while the first cam is formed as a brake cam with, compared with the second cam, reduced cam lift. Here, the cam follower itself is connected to an exhaust valve of the internal combustion engine for example via a rocker, wherein on the rocker or on a valve bridge of the exhaust valve a hydraulic actuating element is provided, which is adjustable between a retracted and an extended position and wherein in the extended position it is operatively connected to the brake cam and brings about a braking stroke while in the retracted position it is decoupled from the brake cam and brings about a cylinder cutout. In the retracted position, a clearance exceeding the cam lift is thus created between the rocker/cam follower and the exhaust valve, so that no transmission of the braking stroke occurs any longer and by way of this a cylinder cutout is realised. With the valve drive according to the invention it is thus possible for the first time to transfer a two-stage system, which exclusively has a normal exhaust cam and a brake cam on the camshaft arranged axially adjacent thereto, into a three-stage system which in addition to the normal operation and the braking stroke operation additionally makes possible also a cylinder cutout. By way of this, additional installation space is required neither in the axial nor in another direction, as a result of which a highly compact design can be realised. In addition, the now three-stage functionality according to the invention can be achieved without significant additional costs since only few further components are required. The further advantages of the valve drive according to the invention are for example a modular structure, design freedom with regards to the brake cam profile since merely the maximum stroke is relevant, a weight saving, less moving mass and a low manufacturing and assembly complexity. Of particular advantage moreover is that the valve drive according to the invention can be employed both with so-called shifting roller and also with connectable rocker arms.

Practically, the adjusting device comprises a first adjustable engagement peg and a second adjustable engagement peg, wherein the first engagement peg interacts with a first slotted guide arranged on the camshaft and the second engagement peg with a second slotted guide arranged on the camshaft. The first engagement peg and the second engagement peg are alternately adjustable between a basic position and a shifting position, wherein in the basic position there is no contact with the associated slotted guide while in the shifting position the respective engagement peg interacts with the associated slotted guide. By way of this, a mechanical adjusting of the cam follower is possible.

Alternatively it is also conceivable that the adjusting device only comprises one single adjustable engagement peg which interacts with a slotted guide having a first slotted track and a second slotted track crossing the same, wherein the engagement peg is alternately adjustable between a basic position and a shifting position and wherein in the basic position there is no contact with the associated slotted guide and in the shifting position the engagement peg interacts with the associated slotted guide. For axially adjusting the cam follower, the engagement peg thus engages alternately into the first slotted track and the second slotted track.

In an advantageous further development of the invention, the hydraulic actuating element comprises a plunger that is extendable in the direction of a valve stem of the associated exhaust valve. In this case, the hydraulic actuating element is thus connected to the rocker, for example screwed to the same or integrated in the same. By way of this, the function of the additional cylinder cutout according to the invention can be achieved comparatively easily by attaching the hydraulic actuating element to the rocker/cam follower, wherein obviously a valve stem of the associated exhaust valve has to be suitably adapted with respect to its length if required. The extendable plunger in this case is extendable between the retracted position and the extended position by a distance X, wherein this distance is greater than a maximum cam lift $lift_{BN}$ of the brake cam, so that in the completely retracted state it creates a clearance between the rocker and the exhaust valve that is greater than the maximum cam lift $lift_{BN}$ of the brake cam and thus brings about a decoupling.

Alternatively it is also conceivable that the hydraulic actuating element comprises a plunger that is extendable in the direction of the rocker or of the cam follower, wherein in this case the hydraulic actuating element is connected to the associated valve bridge, in particular integrated in the same. Here, the piston is also retractable or extendable so far that a maximum adjustment of the plunger by a distance X materialises from this, which is greater than the maximum cam lift $lift_{BN}$ of the brake cam. In this case, the hydraulic actuating element can be comparatively easily connected to the valve bridge of for example two adjacent exhaust valves, in particular screwed. However it is also conceivable that the actuating element is integrated in the valve bridge.

According to the invention, the cam follower is formed axially shiftable on a cam follower shaft. In this case, the cam follower is thus configured as a so-called "shifting roller" and thus has a two-stage functionality. Alternatively it is obviously also conceivable that the rocker comprises a first rocker arm with a first roller and a second rocker arm with a second roller that can be coupled thereto, so that the valve drive according to the invention can be applied also with so-called connectable rocker arms. The valve drive according to the invention is thus not only limited to one embodiment.

The present invention is based, furthermore, on the general idea of equipping an internal combustion engine with the valve drive according to the invention described above and by way of this transfer the installation space advantages, cost advantages and design advantages to the internal combustion engine.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

There it shows, in each case schematically

DETAILED DESCRIPTION

Figure 1:
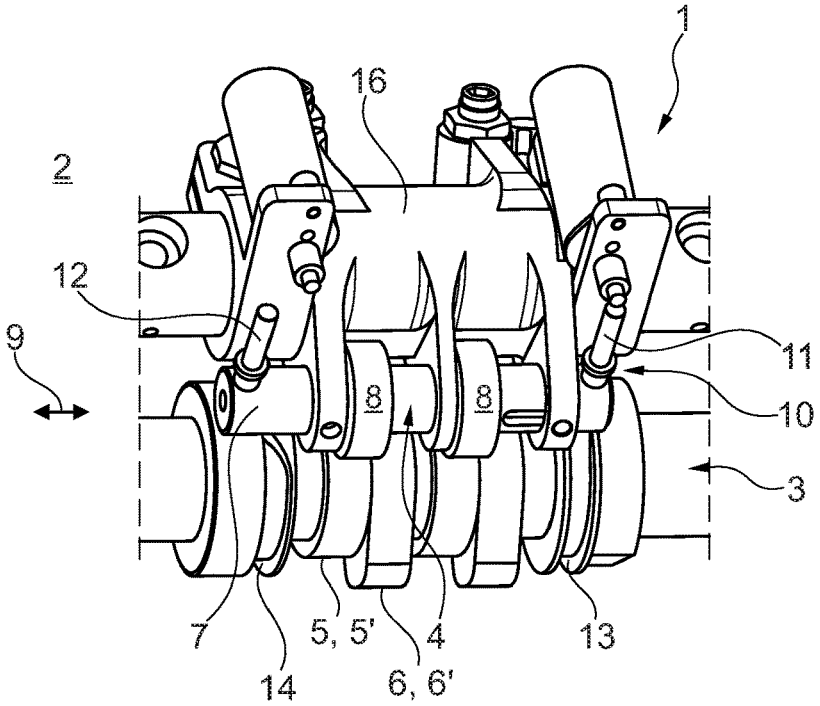
FIG. 1 shows a valve drive according to the invention corresponding to a first embodiment with axially shiftable cam follower.

According to the FIGS. 1 to 6, a valve drive 1 according to the invention comprises a camshaft 3 of an internal combustion engine 2 which is otherwise not shown in more detail having at least one cam follower 4. The camshaft 3 comprises at least one first cam 5 that is non-rotatably fixed on the camshaft 3 and a second cam 6 that is arranged axially adjacent thereto. Here, the cam follower 4 is drive-connected in a first position to the first cam 5 and in a second position to the second cam 6, wherein cam follower 4 according to FIG. 1 is in its first position and because of this is connected to the first cam 5. According to FIG. 1, a roller pin 7, on which individual rollers 8 are rotatably mounted, is adjustable in the axial direction 9. The valve drive 1 additionally comprises an adjusting device 10 with a first adjustable engagement peg 11 and with a second adjustable engagement peg 12, which are arranged spaced next to one another. In the activated state, the first engagement peg 11 can interact with a first slotted guide 13 arranged on the camshaft 3, while the second engagement peg 12 can interact with a second slotted guide 14 arranged on the camshaft 3. The first engagement peg 11 and the second engagement peg 12 are alternately adjustable between a basic position and a shifting position, wherein in the basic position there is no contact with the associated slotted guide 13, 14, while in the shifting position the respective engagement peg 11, 12 interacts with the associated slotted guide 13, 14.

Alternatively and not shown it is also conceivable that the adjusting device 10 only comprises a single adjustable engagement peg 11, which interacts with a slotted guide having a first slotted track and a second slotted track crossing the same, wherein the engagement peg 11 is alternately adjustable between a basic position and a shifting position and wherein in the basic position there is no contact with the associated slotted guide 13 and, in the shifting position, the engagement peg 11 interacts with the associated slotted guide 13.

According to the invention, the second cam 6 is now formed as an exhaust cam 6' and the first cam 5 as a brake cam 5' with, compared with the second cam, a reduced cam lift. Here, the cam follower 4 is itself connected to an exhaust valve 15 (see also the FIGS. 2 to 6) of the internal combustion engine 2 via a rocker 16. According to the invention, a hydraulic actuating element 18 is additionally provided on the rocker 16 or on a valve bridge 17 (see FIGS. 3 and 4), which between an extended position (see the FIGS. 3 and 5) is operatively connected to the brake cam 5', i.e. the first cam 5, and brings about a braking stroke, while in a retracted position (see FIGS. 4 and 6) it is decoupled from the brake cam 5', i.e. from the first cam 5, and brings about a cylinder cutout.

Figure 5:
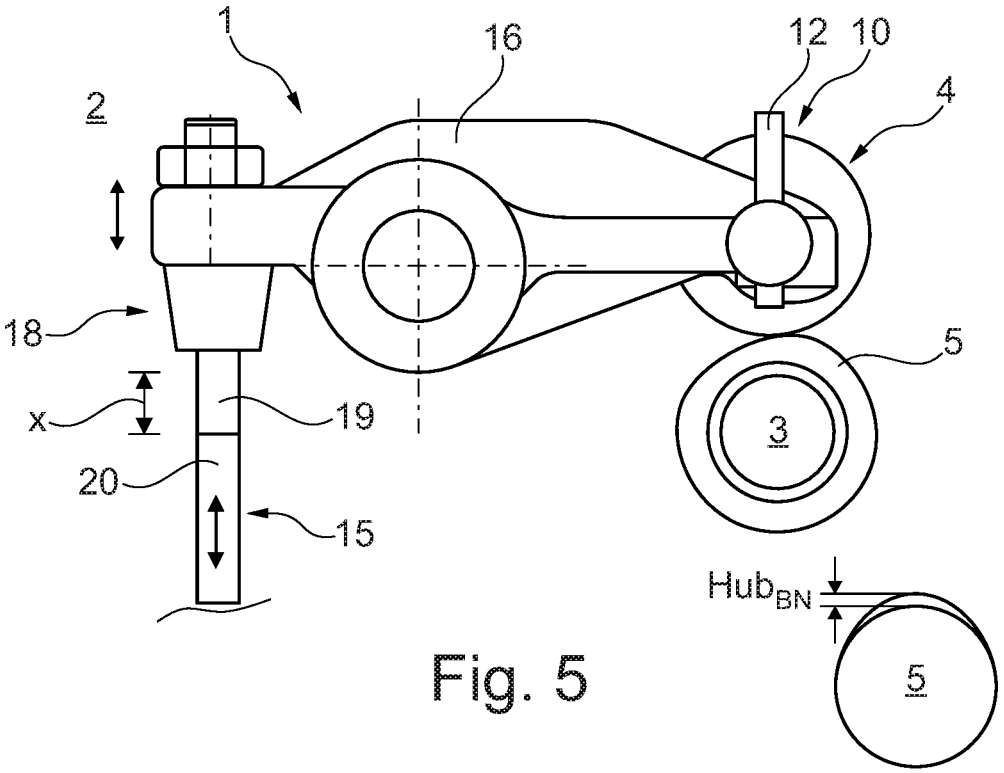
FIG. 5 shows a hydraulic actuating element arranged on the rocker in an extended position.
Figure 6:
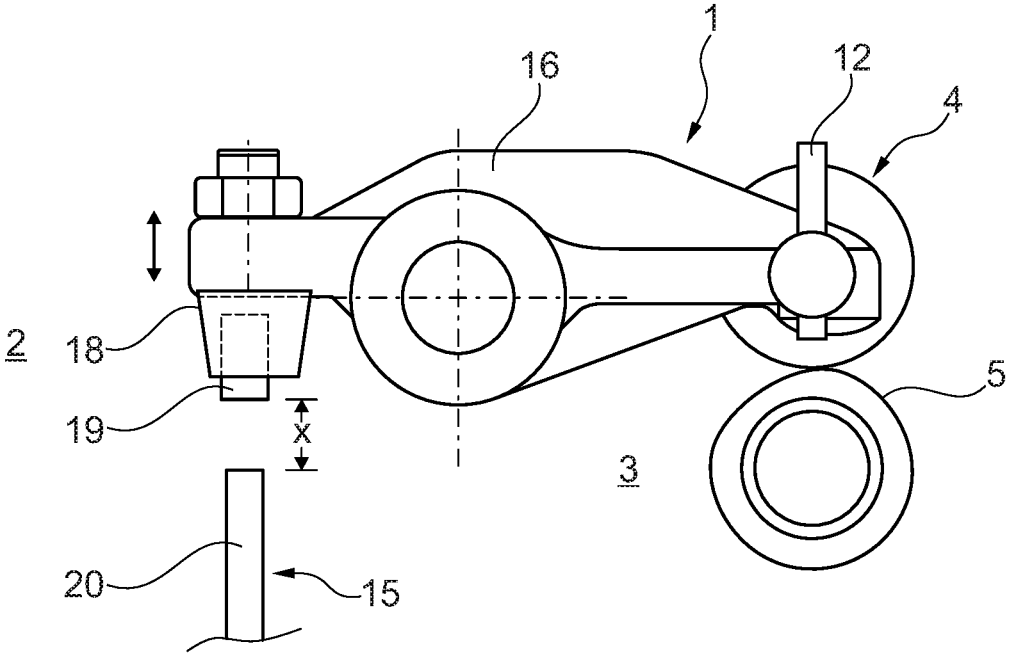
FIG. 6 shows a representation as in FIG. 5, however with a hydraulic actuating element in its retracted position.

When the hydraulic actuating element 18 is arranged on the rocker 16, usually has a plunger 19 that is extendable in the direction of a valve stem 20 of the associated exhaust valve 15, wherein the same according to FIG. 5 is shown in its extended position and according to FIG. 6 in its retracted position. The hydraulic actuating element 18 in this case can be screwed to the rocker 16 and thus be formed easily mountable to the same, or the hydraulic actuating element 18 can be integrated in the rocker 16.

Figure 3:
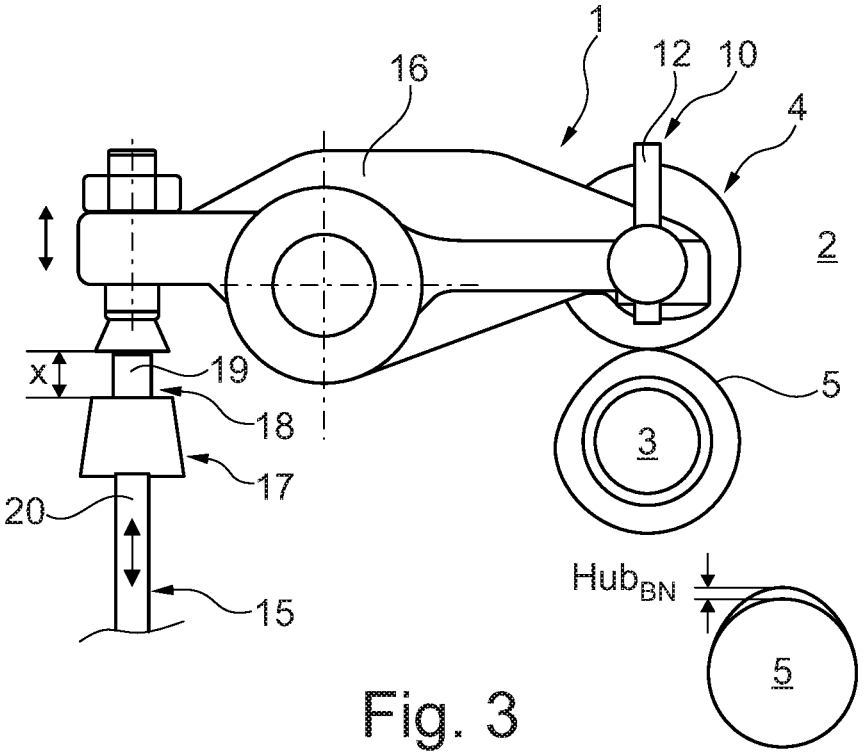
FIG. 3 shows a lateral view of a valve drive according to the invention with a hydraulic actuating element arranged on a valve bridge in an extended position.
Figure 4:
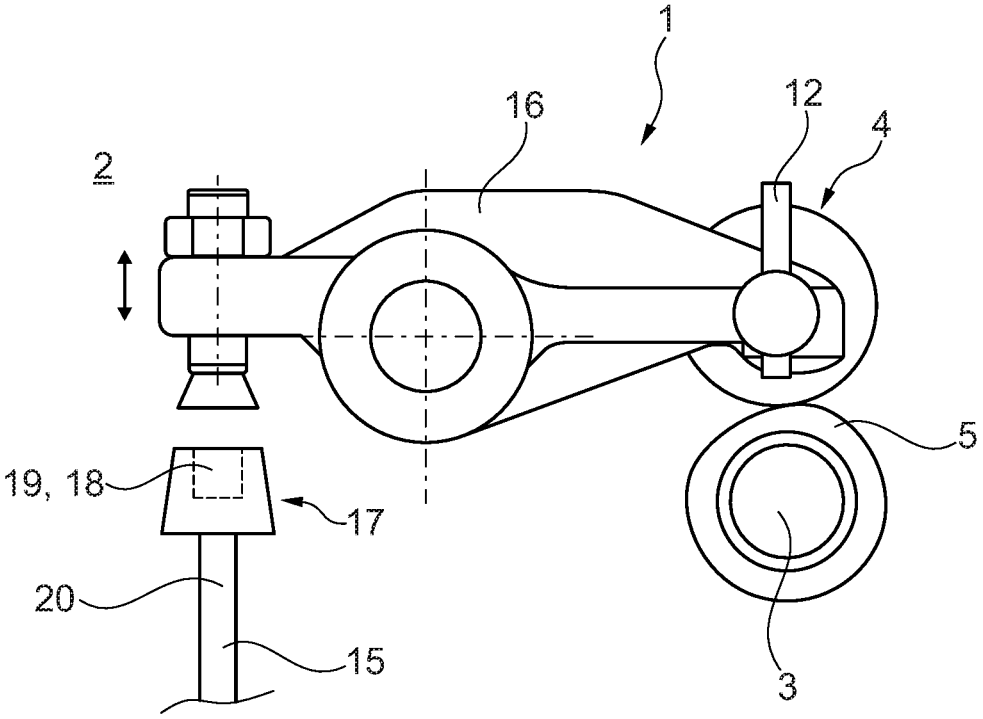
FIG. 4 shows a representation as in FIG. 3, however with a hydraulic actuating element in its retracted position.

When the hydraulic actuating element 18, alternatively to the situation described in the previous paragraph, is arranged on or integrated in the valve bridge 17 of the exhaust valve 15, it usually comprises a plunger 19 that is extendable in the direction of the rocker 16 (see the FIGS. 3 and 4), wherein the plunger 19 according to FIG. 3 is shown in its extended position, in which an operative connection between the exhaust valve 15 and the brake cam 5', i.e. the first cam 5, is brought about. According to FIG. 4, the piston 19 of the hydraulic actuating element 18 is shown in its retracted position, in which there is no operative connection with the associated cam follower 4, i.e. in the present case the rocker 16 and because of this a cylinder cutout takes place. In this case, the hydraulic actuating element 18 is screwed to the valve bridge 17 or integrated in the same.

The extendable plunger 19 in this case is adjustable between the retracted position and the extended position by a distance X, which is greater than a cam lift $lift_{BN}$ of the brake cam 5', i.e. of the first cam 5. By way of this it can be brought about that with completely retracted plunger 19 the clearance X exposed through the retraction movement of the plunger 19 is greater than the maximum cam lift of the brake cam 5', i.e. of the first cam 5, as a result of which the cylinder cutout can be brought about.

Figure 2:
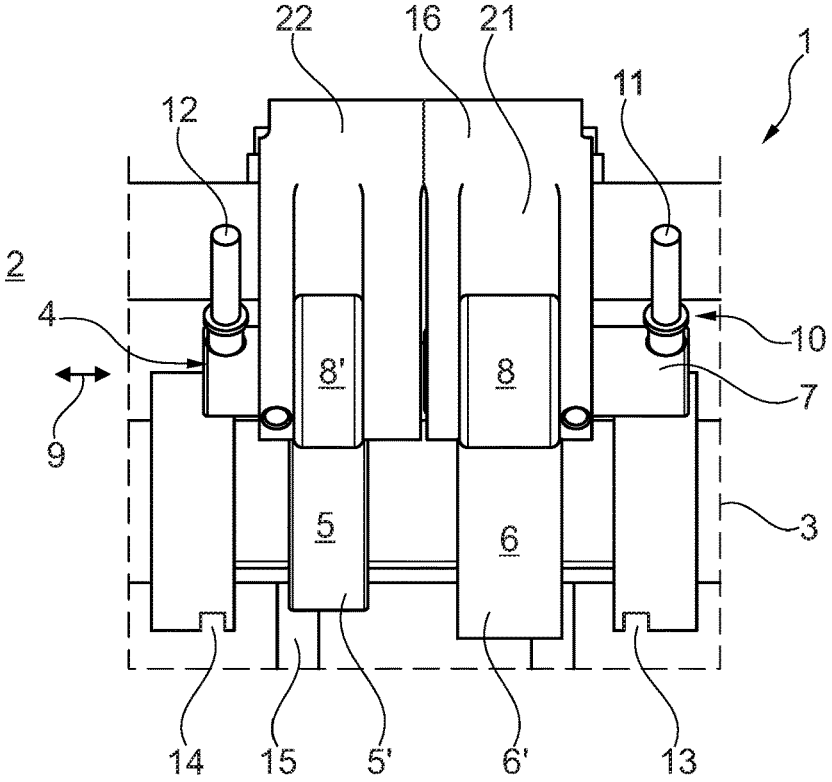
FIG. 2 shows a representation as in FIG. 1, however with a rocker having two rocker arms that can be coupled to one another.

The valve drive 1 according to the invention can be employed both with an axially adjustable cam follower 4, as is shown according to FIG. 1, and also with a cam follower 4, i.e. rocker 16, having a first rocker arm 21 with a first roller 8 and a second rocker arm 22 with a second roller 8' (see FIG. 2). In the embodiment of the valve drive 1 according to the invention shown according to FIG. 2, a coupling of the two rocker arms 21 and 22 occurs during the normal operation, so that the cam follower 4, via the roller 8 of the first rocker arm 21, follows the exhaust cam 6. When the roller pin 7 is shifted to the right, the first rocker arm 21 is decoupled from the second rocker arm 22 and the rocker 16 merely follows the brake cam 5', i.e. the first cam 5, via the second roller 8'. In this state, a decoupling from the associated exhaust valve 15 can then be additionally effected by actuating the hydraulic actuating element 18, as a result of which the cylinder cutout is brought about.

Even with a system that is merely a two-stage system per se, which merely makes possible a normal operation via the second cam 6, i.e. the exhaust cam 6', as well as a braking operation via the brake cam 5', i.e. the first cam 5, the valve drive 1 according to the invention thus makes additionally possible a cylinder cutout without further installation space being required for this purpose. In addition, the hydraulic actuating element 18 according to the invention can be installed in a location that is favourable in terms of design. Because of the low complexity of the valve drive 1 according to the invention a comparatively robust design can also be achieved. Through the modular construction and the few components, assembly advantages and cost advantages are additionally attained. The hydraulic actuating element 18 also constitutes a relatively minor moving mass, as a result of which compared with conventional three-stage systems, substantial weight advantages can be achieved.

The invention claimed is:

1. A valve drive of an internal combustion engine, the valve drive comprising:

a camshaft including at least one first cam non-rotatably coupled on the camshaft and a second cam arranged axially adjacent to the at least one first cam relative to the camshaft, the second cam structured as an exhaust cam and the at least one first cam structured as a brake cam, the at least one first cam having a reduced cam lift relative to the second cam;

at least one cam follower configured to be drive-connected to the at least one first cam when in a first position and to be drive-connected to the second cam when in a second position;

wherein the at least one cam follower is connected to an exhaust valve of the internal combustion engine via a rocker;

wherein a hydraulic actuating element is disposed on one of the rocker and a valve bridge of the exhaust valve, the hydraulic actuating element including a plunger configured to be adjusted between an extended position and a retracted position;

wherein the hydraulic actuating element is operatively connected to the brake cam providing a braking stroke when the plunger is in the extended position; and wherein the hydraulic actuating element is operatively disconnected from the brake cam providing a cylinder cutout when the plunger is in the retracted position.

2. The valve drive according to claim 1, wherein the hydraulic actuating element is disposed on the rocker, and wherein the plunger is configured to extend toward a valve stem of the exhaust valve.

3. The valve drive according to claim 2, wherein an adjustment distance between the extended position and the retracted position of the plunger is greater than a cam lift of the brake cam.

4. The valve drive according to claim 1, wherein the hydraulic actuating element is integrated in the rocker.

5. The valve drive according to claim 1, wherein the hydraulic actuating element is disposed on the valve bridge, and wherein the plunger is configured to extend toward the rocker.

6. The valve drive according to claim 1, wherein the hydraulic actuating element is integrated in the valve bridge.

7. The valve drive according to claim 1, further comprising at least one adjusting device arranged on the at least one cam follower, wherein:

the at least one adjusting device includes a first adjustable engagement peg and a second adjustable engagement peg disposed spaced apart from one another on the at least one cam follower;

the first engagement peg is configured to engage a first slotted guide arranged on the camshaft when in a shifting position and to disengage from the first slotted guide when in a basic position;

the second engagement peg is configured to engage a second slotted guide arranged on the camshaft when in a shifting position and to disengage from the second slotted guide when in a basic position; and the first engagement peg is alternately adjustable between the basic position and the shifting position, and the second engagement peg is alternately adjustable between the basic position and the shifting position.

8. The valve drive according to claim 1, further comprising at least one adjusting device arranged on the at least one cam follower, wherein:

the at least one adjusting device includes an adjustable engagement peg configured to engage a slotted guide when in a shifting position and to disengage from the slotted guide when in a basic position;

the slotted guide includes a first slotted track and a second slotted track crossing the first slotted track; and the engagement peg is alternately adjustable between the basic position and the shifting position.

9. The valve drive according to claim 1, wherein the at least one cam follower is configured to axially shift relative to the camshaft.

10. The valve drive according to claim 1, wherein the rocker includes a first rocker arm with a first roller and a second rocker arm with a second roller, the second rocker arm configured to selectively couple to the first rocker arm.

11. An internal combustion engine, comprising:

a valve drive; and an exhaust valve;

wherein the valve drive includes:

a camshaft including at least one first cam non-rotatably arranged on the camshaft and a second cam arranged axially adjacent to the at least one first cam relative to the camshaft, the second cam structured as an exhaust cam and the at least one first cam structured as a brake cam, the at least one first cam having a reduced cam lift relative to the second cam; and at least one cam follower connected to the exhaust valve via a rocker, the at least one cam follower configured to be drive-connected to the at least one first cam when in a first position and to be drive-connected to the second cam when in a second position;

wherein a hydraulic actuating element is disposed on one of the rocker and a valve bridge of the exhaust valve, the hydraulic actuating element including a plunger configured to be adjusted between an extended position and a retracted position;

wherein the hydraulic actuating element is operatively connected to the at least one first cam providing a braking stroke when the plunger is in the extended position; and wherein the hydraulic actuating element is operatively disconnected from the at least one first cam providing a cylinder cutout when the plunger is in the retracted position.

12. The internal combustion engine according to claim 11, wherein the hydraulic actuating element is disposed on the rocker, and wherein the plunger is configured to extend toward a valve stem of the exhaust valve.

13. The internal combustion engine according to claim 11, wherein the hydraulic actuating element is integrated in the rocker.

14. The internal combustion engine according to claim 11, wherein the hydraulic actuating element is disposed on the valve bridge, and wherein the plunger is configured to extend toward the rocker.

15. The internal combustion engine according to claim 14, wherein an adjustment distance between the extended position and the retracted position of the plunger is greater than a cam lift of the at least one first cam.

16. The internal combustion engine according to claim 11, wherein the hydraulic actuating element is integrated in the valve bridge.

17. The internal combustion engine according to claim 11, further comprising at least one adjusting device arranged on the at least one cam follower, wherein:

the at least one adjusting device includes a first adjustable engagement peg and a second adjustable engagement peg disposed spaced apart from one another on the at least one cam follower, the first engagement peg configured to engage a first slotted guide arranged on the camshaft when in a shifting position and to disengage from the first slotted guide when in a basic position, and the second engagement peg configured to engage a second slotted guide arranged on the camshaft when in a shifting position and to disengage from the second slotted guide when in a basic position; and the first engagement peg is alternately adjustable between the basic position and the shifting position, and the second engagement peg is alternately adjustable between the basic position and the shifting position.

18. The internal combustion engine according to claim 11, further comprising at least one adjusting device arranged on the at least one cam follower, wherein:

the at least one adjusting device includes an adjustable engagement peg configured to engage a slotted guide when in a shifting position and to disengage from the slotted guide when in a basic position;

the slotted guide includes a first slotted track and a second slotted track crossing the first slotted track; and the engagement peg is alternately adjustable between the basic position and the shifting position.

19. The internal combustion engine according to claim 11, wherein the at least one cam follower is configured to axially shift relative to the camshaft.

20. The internal combustion engine according to claim 11, wherein the rocker includes a first rocker arm with a first roller and a second rocker arm with a second roller, the second rocker arm configured to selectively couple to the first rocker arm.

* * * * *